United States Patent [19]

Lopacki et al.

[11] 4,417,389

[45] Nov. 29, 1983

[54] METHOD OF TERMINATING CARBON CERAMIC COMPOSITION RESISTORS FOR USE IN HIGH PEAK POWER AND PEAK VOLTAGE ENERGY DISSIPATION APPLICATION

[75] Inventors: John B. Lopacki, North Tonawanda; Harry R. Emes, Niagara Falls, both of N.Y.

[73] Assignee: Kennecott Corporation, Stamford, Conn.

[21] Appl. No.: 352,962

[22] Filed: Feb. 26, 1982

[51] Int. Cl.[3] ..... H01C 17/28

[52] U.S. Cl. ..... 29/619; 29/621; 219/541; 338/332

[58] Field of Search ..... 338/55, 222, 273, 274, 338/330, 322, 332, 223, 224; 339/223 S; 219/541, 553; 29/611, 619, 620, 621; 373/127; 427/50, 101, 102, 250

[56] References Cited

U.S. PATENT DOCUMENTS

| | | | |
|---|---|---|---|
| 2,708,701 | 5/1955 | Viola | 338/332 X |
| 2,745,928 | 5/1956 | Glaser | 338/332 |
| 2,903,666 | 9/1959 | Krellner | 338/330 |
| 3,167,451 | 1/1965 | Tierman | 427/50 |
| 3,173,121 | 3/1965 | Murry | 338/237 |
| 3,284,879 | 11/1966 | Negre | 29/621 |
| 3,444,616 | 5/1969 | Ferretti et al. | 29/621 |
| 3,676,925 | 7/1972 | Sato et al. | 29/613 |
| 4,189,509 | 2/1980 | Hill | 427/102 |

*Primary Examiner*—Volodymyr Y. Mayewsky
*Attorney, Agent, or Firm*—R. Lawrence Sahr; Harold M. Snyder

[57] ABSTRACT

An electrical resistor is described which is comprised of a resistor core having at least one electrically conductive end cap mounted thereon. The end cap is in electrical contact with the butt end portion of the core and electrically insulated from the side, or periphery, portion of the core member. The end cap has an outward-extending radial portion thereon, positioned contiguous to the junction between the core and the cap.

The present electrical resistors are produced by forming a resistive core member of a conductor in a dielectric matrix material and an end cap, having an internal contact surface and a receiving portion. The receiving portion is larger than the outside diameter of the core. The end cap has an outward-extending radial position adjacent the receiving portion. The end cap is mounted on the core to place the butt end portion of the core in electrical contact with the internal contact surface of the end cap, but otherwise spacedly within the end cap. The space between the receiving end of the cap and the side portion of the core is filled with an electrically insulating material, for example, a thermosetting resin.

5 Claims, 2 Drawing Figures

METHOD OF TERMINATING CARBON CERAMIC COMPOSITION RESISTORS FOR USE IN HIGH PEAK POWER AND PEAK VOLTAGE ENERGY DISSIPATION APPLICATION

BACKGROUND OF THE INVENTION

The present invention relates to electrical resistors and, more in particular, to resistors having improved end caps, or terminal members, and to a method of making improved electrical resistors. The present resistors are of the type that have a resistance element, or core, of a material of the desired electrical conductivity and have conductive end caps, or terminal members, adapted to be connected in an electrical circuit by being detachably secured between a pair of spring clips, clamps or other mounting.

Such resistors have been in use over a long period of time. Typically, they are described in U.S. Pat. Nos. 1,864,336, Bradley, and 2,385,702, Hediger, et al.

Previously, such resistors were assembled by metallizing the resistance element, or core member, along a portion of the perimeter and end to provide good electrical contact with the end caps. The prior art resistors have an inherent arcing problem in that a corona is produced at the boundary line of the core member and the metallized end. Such corona ionized the surrounding air, thus promoting arcing, particularly when the resistor is exposed to high voltage conditions.

GENERAL DESCRIPTION OF THE INVENTION

The present electrical resistor is comprised of a resistor core having at least one electrically conductive end cap mounted thereon. The end cap is in electrical contact with the butt end portion of the core and electrically insulated from the side, or periphery, portion of the core member. The end cap has an outward-extending radial portion thereon, positioned contiguous to the junction between the core and the cap. The tendency for a corona to develop is substantially reduced by the outward-extending radial portion which provides an electrical barrier by the elimination of sharp edges, and by the elimination of exposed electrical contact between the core and cap. In the present resistor, current is distributed through the resistor body cross-section rather then through the sides. This provides continuity and maximizes the cross-section for current flow, particularly in the case of high rise time and high current pulses. The only electrical contact between the core and cap is within the cap and only at the butt end of the core. Generally, the extended radial portion extends outward from the core body from about 0.16 to about 1.27 cm. and, more preferably, from about 0.32 to about 0.80 cm. The extended portion usually is between about 0.16 to about 1.27 cm. in width and, more preferably, from about 0.32 to about 0.80 cm. in width. The extended portion may suitably be formed as a integral part of the end cap by shaping the end cap as it is originally formed. Less desirable, but also operable, is the addition of a separate radial ring member attached to the end cap. Usually, resistors of the type discussed herein are produced with the core being in the shape of an elongated cylinder, either solid or hollow, and the cap members are fabricated to engage the outside diameter of the core. The invention may also be applied to resistors having core bodies made up of a plurality of discs, or washers, and the term "core", as used herein, is meant to encompass such assemblies.

The cap of the present resistor is electrically insulated from the side portion of the core. This is suitably accomplished by fabricating the portion of the cap member adapted to receive the core to be slightly larger, generally, from about 0.08 to about 0.64 cm. and, more preferably, from about 0.16 to about 0.32 cm., than the outside diameter of the core. The space between the side portion of the core and the receiving portion of the cap is filled suitably by injecting or packing, a layer of electrically insulating material therein. Particularly useful insulating materials are thermosetting resins.

The present electrical resistors are produced by forming a resistive core member of a conductor in a dielectric matrix material. The core member is preferably coated with an electrically insulating material. An end cap is then formed, having an internal contact surface and a counter bore, or receiving portion. The receiving portion is larger than the outside diameter of the core or the coated core. The end cap has an outward-extending radial portion adjacent the receiving portion. The end cap is mounted on the core to place the end portion of the core in electrical contact with the contact surface of the end cap, but otherwise spacedly place the core within the end cap. The space between the receiving end of the end cap and the side portion of the core is filled with an electrically insulating material, for example, a thermosetting resin.

BRIEF DESCRIPTION OF THE DRAWINGS

Advantages of the present invention will become apparent as the following detailed description is considered in connection with the accompanying drawings, in which.

DETAILED DESCRIPTION OF THE INVENTION

The present invention will be described in detail by reference to the accompanying drawings, which are partial views in cross-section of resistor units embodying the present invention.

Figure 1:
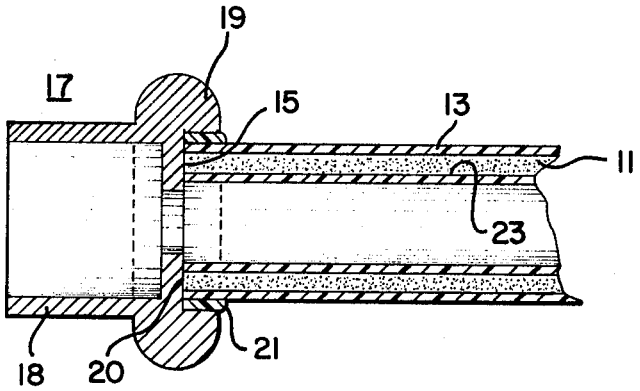
FIG. 1 is a view in section of the electrical resistor structure of the present invention and FIG. 2 is a view in section of a modified embodiment of the electrical resistor structure of the invention.

As shown in FIG. 1, the resistor unit is comprised of a hollow, cylindrical core 1 having a desired electrical condictivity. Generally, resistor cores are composed of an electrically conducting material, such as carbon, distributed in a matrix of insulating material. In practice, cores are produced by forming a mix of conductive material, fillers and binders, which is subsequently extruded, or otherwise formed into rods or other desired shapes. The core is then hardened by firing at a high temperature to effect a vitrification of the core material to form a strong, coherent mass. A length of such product is then cut off, if required, to produce a core of the desired length, such as 11.

Resistor cores are usually sealed from the atmosphere to prevent infiltration of contaminants which would alter the electrical characteristics of the core. As shown, core 11 is coated with a coating 13, which extends the entire length of core 11 and covers the inside diameter of core 11, with the exception of butt end portion 15. A particularly useful coating is silicone, which may be painted or otherwise applied to core 11 and substantially baked, to form an impervious coating.

Previously, the coatings had to have a coefficient of thermal expansion which is substantially similar to that of the end cap to insure maintaining an impervious seal. The present invention allows a substantially wide range of expansion between the coating and cap and thus facilitates a greater selection of coating materials and greater variation in end cap materials and designs.

End cap 17 is fabricated of an electrically conducting material, suitably a metal, such as aluminum, copper, brass, nickel or steel. Particularly useful are aluminum and brass. End cap 17 may suitably be fabricated of aluminum or brass and subsequently plated with a metal, such as nickel, to reduce contact resistance and corrosion when the resistors are utilized under adverse environmental conditions. Suitably, end cap 17 has an external contact portion, such as 18, adapted to be clamped, or otherwise electrically connected, to an electrical circuit. End cap 17 has an outwardly-extended radial portion 19, positioned contiguous to the juncture of core 11 and cap 17. Cap 17 is mounted on core 11 to place internal contact surface 20 of cap 17 into electrical contact with butt end 15 of core 11. The butt end of the core may be made electrically conductive by flame spraying, tinning, painting or plating with a metal, or by applying a silver, or other conductive, paste to the butt end. The bore, or receiving portion, of cap 17 is adapted to receive core 11 and is of a size larger than the outside diameter of core 11, usually between about 0.08 to about 0.64 cm. larger and, more preferably, between about 0.16 and about 0.32 cm. larger.

The spaced portion between cap 17 and the side portion of core 11 is filled, suitably by pointing or packing with an electrically insulating material, preferably a thermosetting resin. A particularly useful insulating material is epoxy resin, which may be injected into the space between cap 17 and the sides of core 11 and cured in situ by heating to about 150° C. for about two hours.

Extended radial portion 19 of cap 17 provides an anti-corona feature. The absence of sharp edges in end cap 17 appreciably reduces the tendency of the extended radial portion to promote arcing. The only electrical connection between cap 17 and core 11 is at the butt end 15 of core 11 and internal contact 20 of cap 17. Although cap 17 is electrically charged when the resistor is in an electrical circuit, the electrical flow is not through the entire cap 17, but rather it is between end 15 of core 11 through internal contact 20 and external contact 18 of end cap 17. Extended portion 19 provides a means of dissipating over a relatively large area any charges which may be formed on cap 17 and substantially reduces arcing between core 11 and cap 17.

The present resistance units are produced by initially forming a resistance element, or core, such as 11. Preferably, the core is coated with an electrically insulating material. A particularly useful coating is silicone, which may be initially mixed with a carrier, painted on the side portion of the core and subsequently cured. An end cap, such as 17, preferably metallic, is formed, having a counter bore, or receiving portion, larger, usually from about 0.08 to about 0.64 cm. and, preferably, from about 0.16 to about 0.32 cm., than the outer periphery of the core member. The end cap has an outward-extending portion located adjacent to the receiving portion. The extended portion extends outward between about 0.16 and about 1.27 cm. and, more preferably, between about 0.32 and about 0.80 cm. from the side of the core member when the cap is mounted on the core. Cap 17 is then mounted on core 11 to place internal contact surface 20 in electrical contact with butt end portion 15 of core 11. Internal contact surface 20, as shown in this illustration, is suitably formed by an internal flange adapted to physically and electrically contact butt end 15 of core 11. The flange, or contact surface, 20 has a cross-sectional area equal to or greater than the cross-sectional area of butt end 15. The core otherwise is in a spaced relation to the end cap. Generally, a space of between about 0.08 and about 0.64 cm. and, more preferably, between about 0.16 and about 0.32 cm., is maintained between the receiving portion of the end cap and the side walls of the core. This space is subsequently filled, suitably by injecting an insulating material 21, for example, a thermosetting resin, such as an epoxy resin, therein.

Figure 2:
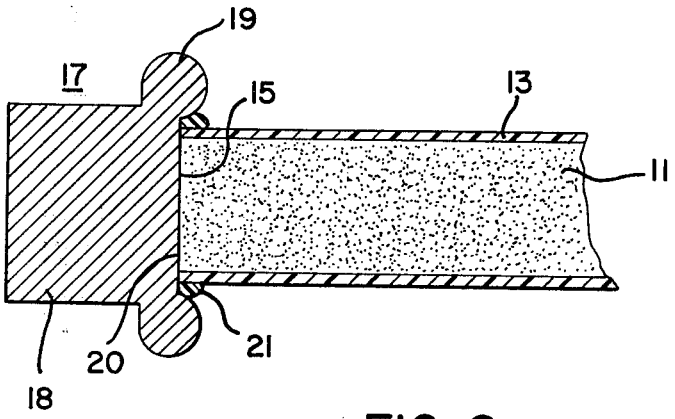

FIG. 2 illustrates alternative embodiments of the invention shown in FIG. 1. As shown in FIG. 2, outward-extending radial portion 19 of cap 17 is substantially fully rounded in cross-section. This embodiment further eliminates sharp edges in cap 17 and facilitates easier injection of electrically insulating material 21 between cap 17 and core 11. FIG. 2 also illustrates the use of a solid resistor core 11 and a solid end cap 17.

The foregoing description and embodiments are intended to illustrate the invention without limiting it thereby. It will be understood that various modifications can be made in the invention without departing from the spirit or scope thereof.

What is claimed is:

1. A method of producing an electrical resistor comprising the steps of:

a. forming a resistance core member of conductive material in a dielectric matrix material having end and side portions, b. forming an end cap member having an internal contact surface and a receiving portion, said receiving portion adapted to spacedly receive said core member allowing a space between about 0.08 and about 0.64 cm. between the side portion of said core member and said receiving portion, said cap member having an outward-extending radial portion thereon adapted to extend outward from about 0.16 to about 1.27 cm. from the side of said core when said cap member is mounted on said core, c. spacedly mounting said core member within the receiving portion of said cap member, placing the contact surface of said cap member into electrical contact with the end of said core member, and d. filling said space between the side portion of said core member and the receiving portion of said cap member with an electrically insulating material.

2. The method of claim 1 wherein said resistance core member is coated with an electrically insulating material on all surfaces except the end portions adapted to be in electrical contact with said end cap member.

3. The method of claim 1 wherein said end cap is fabricated of a metal selected from aluminum, copper, brass, nickel and steel.

4. The method of claim 1 wherein the electrically insulating material in step d. is a thermosetting resin.

5. The method of claim 4 wherein the thermosetting resin is epoxy resin.

* * * * *